US006977177B1

(12) United States Patent
Ho et al.

(10) Patent No.: US 6,977,177 B1
(45) Date of Patent: Dec. 20, 2005

(54) METHOD FOR MARKING HYDROCARBONS WITH SUBSTITUTED ANTHRAQUINONES

(75) Inventors: Kim Sang Ho, Richboro, PA (US); David Roderick Baxter, Mirfield (GB)

(73) Assignee: Rohm and Haas Company, Philadelphia, PA (US)

( * ) Notice: Subject to any disclaimer, the term of this patent is extended or adjusted under 35 U.S.C. 154(b) by 0 days.

(21) Appl. No.: 10/854,046

(22) Filed: May 26, 2004

(51) Int. Cl.[7] ..... G01N 21/64
(52) U.S. Cl. ..... 436/56; 436/172
(58) Field of Search ..... 436/27, 29, 56, 436/164, 166, 172

(56) References Cited

U.S. PATENT DOCUMENTS

| | | | | |
|---|---|---|---|---|
| 2,611,772 A | | 9/1952 | Allen et al. | |
| 2,727,045 A | | 12/1955 | McSheahy | |
| 3,164,449 A | | 1/1965 | Buxbaum et al. | |
| 3,847,953 A | * | 11/1974 | Sill et al. | 552/266 |
| 3,883,568 A | * | 5/1975 | Turner et al. | 552/262 |
| 4,755,012 A | | 7/1988 | Kojima | |
| 4,764,474 A | * | 8/1988 | Orelup | 436/111 |
| 5,304,493 A | * | 4/1994 | Nowak | 436/56 |
| 5,342,974 A | | 8/1994 | Ohyama et al. | |
| 5,525,516 A | | 6/1996 | Krutak et al. | |
| 5,627,077 A | * | 5/1997 | Dyllick-Brenzinger et al. | 436/106 |
| 5,663,386 A | | 9/1997 | Raulfs et al. | |
| 5,804,447 A | | 9/1998 | Albert et al. | |
| 5,942,292 A | * | 8/1999 | Yoneda et al. | 428/402 |
| 6,274,381 B1 | * | 8/2001 | Pauls et al. | 436/56 |
| 6,312,958 B1 | | 11/2001 | Meyer et al. | |
| 6,811,575 B2 | * | 11/2004 | Ho et al. | 8/521 |
| 2004/0110302 A1 | * | 6/2004 | Vamvakaris et al. | 436/56 |

FOREIGN PATENT DOCUMENTS

| | | |
|---|---|---|
| EP | 0 201 368 | 3/1986 |
| JP | 61-246258 | 11/1986 |
| JP | 61-291652 | 12/1986 |
| JP | 62-15260 | 1/1987 |

OTHER PUBLICATIONS

U.S. Appl. No. 10/308,618, filed Dec. 3, 2002, Chen et al.
U.S. Appl. No. 10/857,394, filed May 28, 2004, Baxter et al.

* cited by examiner

*Primary Examiner*—Jeffrey R. Snay
(74) *Attorney, Agent, or Firm*—Kenneth Crimaldi

(57) ABSTRACT

A method for marking a liquid petroleum hydrocarbon. The method comprises adding to the liquid petroleum hydrocarbon at least one substituted anthraquinone dye having formula (I)

(I)

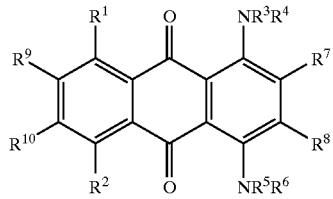

wherein $R^1$ and $R^2$ independently are hydrogen, hydroxy, $OR^{11}$, amino or $NR^{11}R^{12}$; $R^3$ and $R^5$ independently are alkyl, aryl, aralkyl, heteroalkyl or heterocyclic; $R^4$ and $R^6$ independently are hydrogen or alkyl; $R^7$, $R^8$, $R^9$ and $R^{10}$ independently are cyano, nitro or hydrogen, provided that at least two of $R^7$, $R^8$, $R^9$ and $R^{10}$ are cyano or nitro; $R^{11}$ is alkyl, aryl, aralkyl, heteroalkyl, heterocyclic or alkanoyl; $R^{12}$ is hydrogen or alkyl; and wherein the substituted anthraquinone dye(s) has an absorption maximum in the range from 690 nm to 1000 nm.

10 Claims, No Drawings

METHOD FOR MARKING HYDROCARBONS WITH SUBSTITUTED ANTHRAQUINONES

BACKGROUND

This invention relates generally to a method for marking petroleum hydrocarbons with substituted anthraquinone compounds for subsequent identification.

Substituted dicyanoanthraquinones, including the following structure,

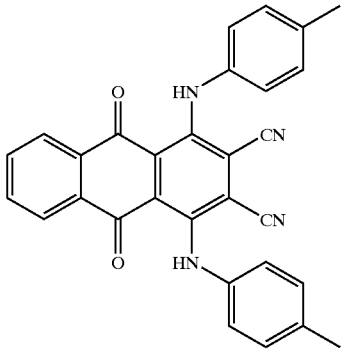

were disclosed in Japanese Patent Application JP61-246258 as colorants for an optical filter. This reference, however, does not suggest a method for marking petroleum hydrocarbons.

A variety of dyes has been used to mark petroleum hydrocarbons. Some of these are expensive, difficult to prepare, or unstable. Combinations of dyes can be used as digital marking systems, with the ratios of amounts forming a code for the marked product. Additional compounds useful as petroleum markers would be desirable to maximize the available codes. The problem addressed by this invention is to find additional markers useful for marking petroleum hydrocarbons.

STATEMENT OF INVENTION

The present invention is directed to a method for marking a liquid petroleum hydrocarbon. The method comprises adding to the liquid petroleum hydrocarbon at least one substituted anthraquinone dye having formula (I)

(I)

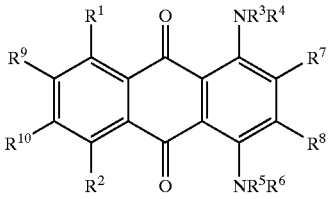

wherein $R^1$ and $R^2$ independently are hydrogen, hydroxy, $OR^{11}$, amino or $NR^{11}R^{12}$; $R^3$ and $R^5$ independently are alkyl, aryl, aralkyl, heteroalkyl or heterocyclic; $R^4$ and $R^6$ independently are hydrogen or alkyl; $R^7$, $R^8$, $R^9$ and $R^{10}$ independently are cyano, nitro or hydrogen, provided that at least two of $R^7$, $R^8$, $R^9$ and $R^{10}$ are cyano or nitro; $R^{11}$ is alkyl, aryl, aralkyl, heteroalkyl, heterocyclic or alkanoyl; $R^{12}$ is hydrogen or alkyl; and wherein the substituted anthraquinone dye(s) has an absorption maximum in the range from 690 nm to 1000 nm.

DETAILED DESCRIPTION

All percentages are weight percentages, unless otherwise indicated. Concentrations in parts per million ("ppm") are calculated on a weight/volume basis. When a solvent is not specified for measurement of an absorption maximum, a hydrocarbon solvent is preferred. Extinction values are determined by measuring absorption in absorbance units ("AU") with a 1 cm path length on 10 mg/L solutions. The term "petroleum hydrocarbons" refers to products having a predominantly hydrocarbon composition, although they may contain minor amounts of oxygen, nitrogen, sulfur or phosphorus; petroleum hydrocarbons are derived from petroleum refining processes; they include, for example, lubricating oil, hydraulic fluid, brake fluid, gasoline, diesel fuel, kerosene, jet fuel and heating oil. An "alkyl" group is a hydrocarbyl group having from one to twenty carbon atoms in a linear, branched or cyclic arrangement. Alkyl groups optionally have one or more double or triple bonds. Substitution on alkyl groups of one or more halo, hydroxy or alkoxy groups is permitted; alkoxy groups may in turn be substituted by one or more halo substituents. Preferably, alkyl groups have no halo or alkoxy substituents, and most preferably, alkyl groups are saturated and unsubstituted. A "heteroalkyl" group is an alkyl group in which at least one carbon has been replaced by O, NR, or S, wherein R is hydrogen, alkyl, aryl or aralkyl. An "aryl" group is a substituent derived from an aromatic hydrocarbon compound. An aryl group has a total of from six to twenty ring atoms, and has one or more rings which are separate or fused. An "aralkyl" group is an "alkyl" group substituted by an "aryl" group. A "heterocyclic" group is a substituent derived from a heterocyclic compound having from five to twenty ring atoms, at least one of which is nitrogen, oxygen or sulfur. Preferably, heterocyclic groups do not contain sulfur. Substitution on aryl or heterocyclic groups of one or more of the following groups: halo, cyano, nitro, hydroxy, alkoxy, alkyl, heteroalkyl, alkanoyl, amino, or amino substituted by one or more of alkyl, aryl, aralkyl, heterocyclic, heteroalkyl or alkanoyl is permitted, with substitution by one or more halo groups being possible on alkyl, heteroalkyl, alkanoyl or alkoxy groups. Preferably, aryl and heterocyclic groups do not contain halogen atoms. In one preferred embodiment of the invention, aryl and heterocyclic groups are unsubstituted or substituted only by alkyl groups. An "aromatic heterocyclic" group is a heterocyclic group derived from an aromatic heterocyclic compound.

In one embodiment of the invention, $R^4$ and $R^6$ are hydrogen; in another embodiment, $R^4$ and $R^6$ are alkyl, preferably $C_1$–$C_4$ saturated unsubstituted acyclic alkyl. In one embodiment of the invention, $R^3$, $R^5$ and $R^{11}$ in formula (I) are alkyl, aryl or aromatic heterocyclic. Preferably, $R^3$ and $R^5$ represent the same substituent. In one embodiment of the invention, $R^3$ and $R^5$ are aryl substituted by at least one $C_2$–$C_{20}$ alkyl group or aromatic heterocyclic substituted by at least one $C_2$–$C_{20}$ alkyl group; alternatively, $R^3$ and $R^5$ are aryl substituted by at least one $C_4$–$C_{20}$ alkyl group or aromatic heterocyclic substituted by at least one $C_4$–$C_{20}$ alkyl group; preferably $R^3$ and $R^5$ are phenyl substituted by at least one $C_2$–$C_{20}$ alkyl group, more preferably by at least one $C_4$–$C_{20}$ alkyl group. When $R^3$ and $R^5$ are aryl or aromatic heterocyclic groups, preferably $R^4$ and $R^6$ are hydrogen.

In one embodiment of the invention, $R^3$ and $R^5$ are alkyl, preferably $C_2$–$C_{20}$ alkyl, more preferably $C_4$–$C_{20}$ alkyl; preferably $R^3$ and $R^5$ are saturated unsubstituted alkyl. In one embodiment of the invention, $R^3$ and $R^5$ are $C_5$–$C_8$ cyclic alkyl groups; preferably $R^3$ and $R^5$ are saturated unsubstituted $C_5$–$C_8$ Cyclic alkyl groups and $R^4$ and $R^6$ are hydrogen. In one preferred embodiment, $R^3$ and $R^5$ are cyclohexyl. In another preferred embodiment, $R^3$ and $R^5$ are $C_5$–$C_8$ cyclic alkyl groups, R4 and $R^6$ are hydrogen, and $R^1$ and $R^2$ are $NR^{11}R^{12}$, where $R^{12}$ is hydrogen and $R^{11}$ is $C_5$–$C_8$ cyclic alkyl, preferably saturated unsubstituted alkyl; preferably $R^3$ and $R^5$ are cyclohexyl and $R^1$ and $R^2$ are cyclohexylamino.

In another preferred embodiment, $R^3$ and R5 are aryl substituted by at least one $C_2$–$C_{20}$ alkyl group or aromatic heterocyclic substituted by at least one $C_2$–$C_{20}$ alkyl group, $R^4$ and $R^6$ are hydrogen, and $R^1$ and $R^2$ are $NHR^{11}$, where $R^{11}$ is aryl substituted by at least one $C_2$–$C_{20}$ alkyl group or aromatic heterocyclic substituted by at least one $C_2$–$C_{20}$ alkyl group. In one embodiment, $R^7$, $R^8$, $R^9$ and $R^{10}$ are cyano or hydrogen. In one embodiment, $R^7$, $R^8$, $R^9$ and $R^{10}$ all represent cyano. In one embodiment, $R^7$ and $R^8$ represent cyano, and $R^9$ and $R^{10}$ are hydrogen. Preferably, $R^1$ and $R^2$ independently are hydrogen, hydroxy or $NR^{11}R^{12}$. Preferably, $R^{11}$ is alkyl or aryl. In one preferred embodiment of the invention, $R^{11}$ is $C_2$–$C_{20}$ alkyl. Preferably, $R^1$ and $R^2$ represent the same substituent. Most preferably, $R^1$ and $R^2$ represent hydrogen or $NR^{11}R^{12}$. In one embodiment, $R^1$ and $R^2$ are $NR^{11}R^{12}$, and $R^3$, $R^4$, $R^5$, $R^6$, $R^{11}$ and $R^{12}$ are alkyl, preferably the same alkyl group; in one preferred embodiment, $R^3$, $R^4$, $R^5$, $R^6$, $R^{11}$ and $R^{12}$ are $C_1$–$C_4$ saturated unsubstituted acyclic alkyl groups, and most preferably, methyl groups.

In one preferred embodiment of the invention, $R^7$ and $R^8$ are cyano, $R^4$ and $R^6$ are hydrogen, $R^9$ and $R^{10}$ are hydrogen, and a substituted anthraquinone dye has formula (II)

(II)

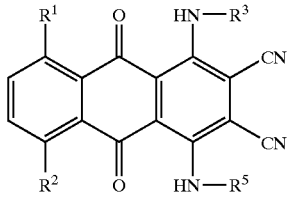

In another preferred embodiment of the invention, $R^7$ and $R^8$ are cyano, $R^4$ and $R^6$ are hydrogen, $R^9$ and $R^{10}$ are hydrogen, $R^1$ and $R^2$ are hydrogen, and a substituted anthraquinone dye has formula (III)

(III)

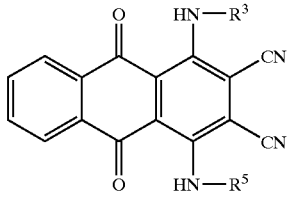

In another preferred embodiment of the invention, $R^7$ and $R^8$ are cyano, $R^4$ and $R^6$ are hydrogen, $R^9$ and $R^{10}$ are hydrogen, $R^1$ and $R^2$ are $NHR^{11}$, and a substituted anthraquinone dye has formula (IV)

(IV)

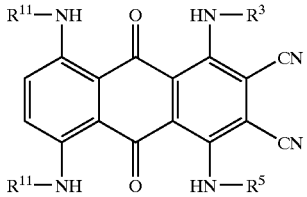

In another preferred embodiment of the invention, $R^7$, $R^8$, $R^9$ and $R^{10}$ are cyano, $R^1$ and $R^2$ are $NHR^{11}$, $R^4$ and $R^6$ are hydrogen, and a substituted anthraquinone dye has formula (V).

(V)

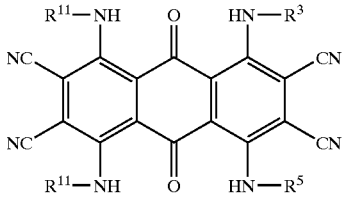

The absorption maxima, $\lambda_{max}$, of several substituted anthraquinone dyes of formula (I) are provided in the following table. For all of the dyes listed, $R^4$ and $R^6$ are hydrogen

| $R^1$, $R^2$ | $R^3$, $R^5$ | $R^7$, $R^8$, $R^9$, $R^{10}$ | $\lambda_{max}$, nm |
|---|---|---|---|
| H, H | 4-$CH_3$Ph, 4-$CH_3$Ph | CN, CN, H, H | 720 |
| H, H | $(CH_3)_2CH$, $(CH_3)_2CH$ | CN, CN, H, H | 715 |
| H, H | $CH_3(CH_2)_3$, $CH_3(CH_2)_3$ | CN, CN, H, H | 700 (xylene) |
| 4-n-BuPhNH, 4-n-BuPhNH | 4-n-BuPh, 4-n-BuPh | CN, CN, H, H | 835 (xylene) |
| 4-n-BuPhNH, 4-n-BuPhNH | 4-n-BuPh, 4-n-BuPh | CN, CN, CN, CN | 900 (xylene) |
| OH, OH | 4-$CH_3$Ph, 4-$CH_3$Ph | CN, CN, H, H | 740 |
| OH, OH | $CH_3(CH_2)_3$, $CH_3(CH_2)_3$ | CN, CN, H, H | 800 |
| OH, OH | $CH_3(CH_2)_{11}$, $CH_3(CH_2)_{11}$ | CN, CN, H, H | 805 |

4-n-BuPh = 4-n-butylphenyl; 4-$CH_3$Ph = 4-methylphenyl

These values were measured in chloroform, except where a different solvent is listed; values in toluene or other hydrocarbons are expected to be approximately 15 nm to 18 nm lower than values measured in chloroform.

Preferably the amount of each substituted anthraquinone dye of formula (I) added to the petroleum hydrocarbon is at least 0.001 ppm, more preferably at least 0.005 ppm, more preferably at least 0.01 ppm, more preferably at least 0.03 ppm, and most preferably at least 0.05 ppm. Preferably the amount of each dye is less than 10 ppm, more preferably less than 2 ppm, more preferably less than 1 ppm and most preferably less than 0.5 ppm. Preferably, the marking is invisible, i.e., the dye cannot be detected by simple visual observation of the marked hydrocarbon. Preferably, a substituted anthraquinone of formula (I) has an absorption maximum in a hydrocarbon solvent of at least 700 nm, more preferably at least 710 nm, more preferably at least 720 nm, more preferably at least 740 nm, and most preferably at least 770 nm. Preferably, a substituted anthraquinone of formula (I) has an absorption maximum in a hydrocarbon solvent of no more than 970 nm, more preferably no more than 930 nm.

In one embodiment of the invention, at least one other dye, not having formula (I), and having an absorption maximum from 690 nm to 1000 nm, but at a wavelength different from that of the substituted anthraquinone of formula (I) is added to the petroleum hydrocarbon. Preferably, the absorption maxima of any two dyes used in the method of this invention, when measured in the same solvent, differ by at least 30 nm, more preferably by at least 50 nm. Preferably, the other dye(s) used in this embodiment has an absorption maximum in a hydrocarbon solvent of at least 700 nm, more preferably at least 710 nm, more preferably at least 720 nm, more preferably at least 740 nm, and most preferably at least 770 nm. Preferably, the other dye(s) has an absorption maximum in a hydrocarbon solvent of no more than 900 nm, more preferably no more than 850 nm, and most preferably no more than 800 nm. In this embodiment of the invention, preferably the other dye(s) is at least one 1,4,5,8-tetrasubstituted anthraquinone dye having formula (VI)

(VI)

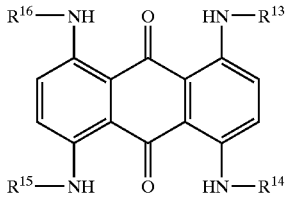

wherein $R^{13}$, $R^{14}$, $R^{15}$ and $R^{16}$ independently are alkyl, aryl, aralkyl, heteroalkyl or heterocyclic. In one embodiment of the invention, at least three of $R^{13}$, $R^{14}$, $R^{15}$ and $R^{16}$ are aryl or aromatic heterocyclic; preferably, all of $R^{13}$, $R^{14}$, $R^{15}$ and $R^{16}$ are aryl. Preferably, $R^{13}$, $R^{14}$, $R^{15}$ and $R^{16}$ represent the same substituent. In one preferred embodiment of the invention, $R1^3$, $R^{14}$, R15 and R16 are aryl substituted by at least one $C_2$–$C_{20}$ alkyl group or aromatic heterocyclic substituted by at least one $C_2$–$C_{20}$ alkyl group, preferably aryl substituted by at least one $C_4$–$C_{20}$ alkyl group or aromatic heterocyclic substituted by at least one $C_4$–$C_{20}$ alkyl group; preferably $R^{13}$, $R^{14}$, $R^{15}$ and $R^{16}$ are phenyl substituted by at least one $C_2$–$C_{20}$ alkyl group, more preferably by at least one $C_4$–$C_{20}$ alkyl group. In one embodiment of the invention, $R^{13}$, $R^{14}$, $R^{15}$ and $R^{16}$ are $C_5$–$C_8$ cyclic alkyl, preferably cyclohexyl. In another embodiment, $R^{13}$, $R^{14}$, $R^{15}$ and $R^{16}$ are unsubstituted saturated acyclic alkyl, preferably $C_2$–$C_{20}$ unsubstituted saturated acyclic alkyl. Preferably the amount of each 1,4,5,8-tetrasubstituted anthraquinone dye added to the petroleum hydrocarbon is at least 0.01 ppm, more preferably at least 0.02 ppm, and most preferably at least 0.03 ppm. Preferably the amount of each dye is less than 10 ppm, more preferably less than 2 ppm, and most preferably less than 1 ppm. A 1,4,5,8-tetrasubstituted anthraquinone dye of formula (VI) also can be used as a marker for a petroleum hydrocarbon without a substituted anthraquinone dye of formula (I).

Another dye suitable for use with a dye of formula (I) is an anthraquinone imine having formula (VII)

(VII)

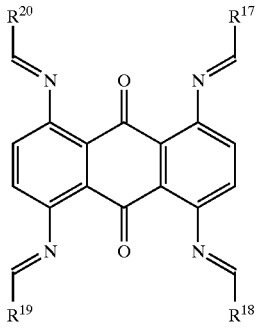

wherein $R^{17}$, $R^{18}$, $R^{19}$ and $R^{20}$ independently are aryl or aromatic heterocyclic. Preferably, $R^{17}$, $R^{18}$, $R^{19}$ and $R^{20}$ are the same aryl or aromatic heterocyclic group. Preferably, $R^{17}$, $R^{18}$, $R^{19}$ and $R^{20}$ are aryl; more preferably $R^{17}$, $R^{18}$, $R^{19}$ and $R^{20}$ are phenyl or substituted phenyl; and most preferably phenyl or phenyl substituted by one or more of hydroxy, alkyl, alkanoyl, aroyl, aryloxy, aralkyloxy and alkoxy. In one preferred embodiment, $R^{17}$, $R^{18}$, $R^{19}$ and $R^{20}$ are phenyl substituted by at least one alkyl group, preferably a $C_2$–$C_{20}$ alkyl group, more preferably a saturated, unsubstituted $C_4$–$C_{20}$ alkyl group. Compounds of formula (VII) can be prepared from condensation of 1,4,5,8-tetraaminoanthraquinone and aryl aldehydes or aromatic heterocyclic aldehydes.

Another dye suitable for use with a dye of formula (I) is a dye of formula (VIII).

(VIII)

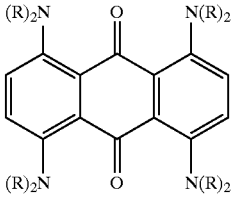

wherein R represents alkyl groups, which may be the same or different. In one embodiment, R is $C_1$–$C_{12}$ alkyl, preferably $C_1$–$C_4$ alkyl. In one embodiment, R is saturated $C_1$–$C_{12}$ alkyl, preferably unsubstituted alkyl. In one embodiment R is $C_1$–$C_4$ saturated unsubstituted acyclic alkyl. Preferably, all R groups are the same alkyl group. Most preferably, all R groups are methyl groups. Preferably the amount of each dye of formula (VIII) added to the petroleum hydrocarbon is at least 0.01 ppm, more preferably at least 0.02 ppm, and most preferably at least 0.03 ppm. Preferably the amount of each dye is less than 10 ppm, more preferably less than 2 ppm, and most preferably less than 1 ppm.

In one embodiment of the invention, at least one dye having an absorption maximum in a hydrocarbon solvent in the range from 630 nm to 720 nm, more preferably from 630 nm to 700 nm, and most preferably from 650 nm to 700 nm, is added to the petroleum hydrocarbon together with a dye of formula (I). Preferably, the dye(s) is a 1,4,5-trisubstituted anthraquinone dye of formula (IX).

(IX)

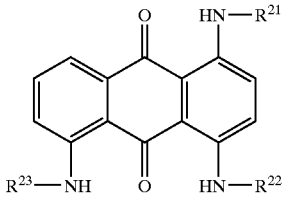

wherein $R^{21}$, $R^{22}$ and $R^{23}$ independently are alkyl, aryl, aralkyl, heteroalkyl or heterocyclic. Preferably, at least two of $R^{21}$, $R^{22}$ and $R^{23}$ are aryl or aromatic heterocyclic. More preferably, all three of $R^{21}$, $R^{22}$ and $R^{23}$ are aryl or aromatic heterocyclic. Most preferably, all three of $R^{21}$, $R^{22}$ and $R^{23}$ are aryl. Preferably, $R^{21}$, $R^{22}$ and $R^{23}$ represent the same substituent. In one preferred embodiment of the invention, $R^{21}$, $R^{22}$ and $R^{23}$ are aryl substituted by at least one $C_2$–$C_{20}$ alkyl group or aromatic heterocyclic substituted by at least one $C_2$–$C_{20}$ alkyl group; aryl substituted by at least one $C_4$–$C_{20}$ alkyl group or aromatic heterocyclic substituted by at least one $C_4$–$C_{20}$ alkyl group; preferably $R^{21}$, $R^{22}$ and $R^{23}$ are phenyl substituted by at least one $C_2$–$C_{20}$ alkyl group, more preferably by at least one $C_4$–$C_{20}$ alkyl group. 1,4,5-trisubstituted anthraquinones can be prepared from commercially available 1,4,5-trichloroanthraquinone, whose preparation is reported in the prior art (see U.S. Pat. Nos. 4,006,171 and 4,162,946).

In one preferred embodiment of the invention, a substituted anthraquinone dye of formula (I), a 1,4,5,8-tetrasubstituted anthraquinone dye having formula (VI), and a 1,4,5-trisubstituted anthraquinone dye of formula (IX) are added to a petroleum hydrocarbon to comprise a coding system enabling identification of the hydrocarbon according to the relative amounts of the three types of dyes, provided that the absorption maxima, measured in the same solvent, for any pair of dyes are separated by at least 30 nm. In this embodiment, preferably the 1,4,5-trisubstituted anthraquinone dye of formula (VII) has an absorption maximum in a hydrocarbon solvent from 650 nm to 700 nm, the 1,4,5,8-tetrasubstituted anthraquinone dye having formula (V) has an absorption maximum in a hydrocarbon solvent from 720 nm to 770 nm, and the substituted anthraquinone dye of formula (I) has an absorption maximum in a hydrocarbon solvent from 780 nm to 900 nm.

Preferably, the dyes are detected by exposing the marked hydrocarbon to electromagnetic radiation having wavelengths in the portion of the spectrum containing the absorption maxima of the dyes and detecting the absorption of light or fluorescent emissions. It is preferred that the detection equipment is capable of calculating dye concentrations and concentration ratios in a marked hydrocarbon. Typical spectrophotometers known in the art are capable of detecting the dyes used in the method of this invention when they are present at a level of at least 0.01 ppm. It is preferred to use the detectors described in U.S. Pat. No. 5,225,679, especially the SpecTrace™ analyzer available from Rohm and Haas Company, Philadelphia, Pa. These analyzers use a filter selected based on the absorption spectrum of the dye, and use chemometric analysis of the signal by multiple linear regression methods to reduce the signal-to-noise ratio.

When the detection method does not involve performing any chemical manipulation of the marked hydrocarbon, the sample may be returned to its source after testing, eliminating the need for handling and disposal of hazardous chemicals. This is the case, for example, when the dyes are detected simply by measuring light absorption by a sample of the marked hydrocarbon.

In one embodiment of the invention, the dye is formulated in a solvent to facilitate its addition to the liquid hydrocarbon. The preferred solvents for substituted anthraquinone dyes are N-methylpyrrolidinone, N,N-dimethyl propylene urea, nitrobenzene, toluene, N,N-dimethylformamide and 2-secbutylphenol. Preferably, the dye is present in the solvent at a concentration of from 0.1% to 10%.

In one embodiment of the invention, at least one substituted anthraquinone dye of formula (I) having an absorption maximum from 690 nm to 1000 nm, and optionally another dye having an absorption maximum from 690 nm to 1000 nm, are added to a petroleum hydrocarbon with at least one visible dye; i.e., a dye having an absorption maximum in the range from 500 nm to 700 nm, preferably from 550 nm to 700 nm, and most preferably from 550 nm to 650 nm. Preferably, each visible dye is added in an amount of at least 0.1 ppm, preferably at least 0.2 ppm, and most preferably at least 0.5 ppm. Preferably, the amount of each visible dye is no more than 10 ppm, more preferably no more than 5 ppm, more preferably no more than 3 ppm, and most preferably no more than 2 ppm. In a preferred embodiment, the visible dyes are selected from the classes of anthraquinone dyes and azo dyes. Suitable anthraquinone dyes having an absorption maximum in this region include, for example, 1,4disubstituted anthraquinones having alkylamino, arylamino or aromaticheterocyclic-amino substituents at the 1 and 4 positions. Suitable azo dyes having an absorption maximum in this region include the bisazo dyes, for example, those having the structure Ar-N=N-Ar-N=N-Ar, in which Ar is an aryl group, and each Ar may be different. Specific examples of suitable commercial anthraquinone and bisazo dyes having an absorption maximum in this region are listed in the Colour Index, including C.I. Solvent Blue 98, C.I. Solvent Blue 79, C.I. Solvent Blue 99 and C.I. Solvent Blue 100.

Incorporation of at least one substituted anthraquinone dye of formula (I) having an absorption maximum in the region from 690 nm to 1000 nm allows identification of the liquid hydrocarbon by spectrophotometric means in a spectral region relatively free of interference. Low levels of these dyes are detectable in this region, allowing for a cost-effective marking process, and availability of multiple dyes allows coding of information via the amounts and ratios of the dyes. For these reasons, additional compounds absorbing in this range, and suitable as fuel markers, are extremely useful.

Combinations of substituted anthraquinone dyes of formula (I) having absorption maxima in the region from 690 nm to 1000 nm with markers detectable in the region from 500 nm to 700 nm also are useful. Incorporation of higher levels of at least one visible dye having an absorption maximum in the region from 500 nm to 700 nm, preferably from 550 nm to 650 nm, facilitates quantitative spectrophotometric determination in this region. Accurate determination of the dye levels allows the amounts and ratios of the dyes to serve as parts of a code identifying the hydrocarbon. Since dyes absorbing from 550 nm to 650 nm often are less costly, use of a higher level will not greatly increase the overall cost of the marking process. Thus, the combination of the two kinds of dyes increases the flexibility and minimizes the cost of the marking process.

EXAMPLES

Example 1

Synthesis of
1,4-di-(n-butylamino)-2,3-dicyanoanthraquinone.

A mixture of 25.7 parts of Solvent Blue 35{1,4-di-(n-butylamino)anthraquinone}, 14.8 parts of NaCN, 10 parts of $NH_4HCO_3$, and 100 parts of dimethyl sulfoxide (DMSO) was allowed to react at 90–95° C. for 6 hours to give 1,4-di-(n-butylamino)-2,3-dicyanoanthraquinone. This material has a maximum absorption band ($\lambda_{max}$) at a wavelength of 700 nm in xylene with an extinction value of 0.23 AU for 10 mg/L.

Example 2

Synthesis of 1,4,5,8-tetra-(4'-n-butylphenylamino)-2,3-dicyanoanthraquinone and 1,4,5,8-tetra(4'-n-butylphenylamino)-2,3,6,7-tetracyanoanthraquinone.

A mixture of 8.0 parts of 1,4,5,8-tetra(4'-n-butylphenylamino)anthraquinone, 2.53 parts of NaCN, 1.65 parts of $NH_4HCO_3$, and 39 parts of DMSO was allowed to react at 90 –95° C. for 6 hours to give 1,4,5,8-tetra-(4'-nbutylphenylamino)-2,3-dicyanoanthraquinone. The structure of the di-cyano product was confirmed by proton and carbon-13 NMR. This material has a maximum absorption band ($\lambda_{max}$) at a wavelength of 835 nm in xylene with an extinction value of 0.342 AU for 10 mg/L. Longer reaction time also gave rise to the 1,4,5,8-tetra(4'-n-butylphenylamino)-2,3,6,7-tetracyanoanthraquinone. The structure of the tetra-cyano product also was confirmed by proton and carbon-13 NMR. This material has a maximum absorption band ($\lambda_{max}$) at a wavelength of 900 nm in xylene with an extinction value of 0.19 AU for 10 mg/L.

Example 3

Synthesis of
1,4,5-tri(4-n-butylphenylamino)anthraquinone.

A mixture of 10 parts of 1,4,5-trichloroanthraquinone and 95 parts of 4-n-butylaniline was allowed to react at 190° C. for 12 hours. The reaction mixture was then cooled to 70° C. and diluted with an equal amount of ethanol. On standing and further cooling to ambient temperature, some precipitate is formed. The precipitate was filtered, washed, and recrystallized from a mixture of xylenes and 2-propanol to give 6 parts of a dark blue crystalline material (>95% purity) with the structure confirmed by mass spectrometry as the desired product of 1,4,5-tri(4-n-butylphenylamino)-anthraquinone. This material has a maximum absorption band ($\lambda_{max}$) at a wavelength of 675 nm in toluene.

Example 4

Synthesis of
1,4,5,8-tetra(phenylamino)anthraquinone

A mixture of 10.87 g of 1,4,5,8-tetrachloroanthraquinone, 50 g of aniline, 13.4 g of potassium acetate, 1.24 g of copper sulfate, and 3.41 g of benzyl alcohol was heated to 130° C. under nitrogen and maintained at this temperature for 6.5 hours, followed by another holding period at 170° C. for 6 hours. The reaction mixture was cooled to ambient temperature and the precipitate was filtered to give black solids. Recrystallization of the crude product from toluene afforded 6.0 g of a dark green crystalline material (> 95% purity with the structure confirmed by proton NMR as the desired product: 1,4,5,8-tetra(phenylamino)anthraquinone. This material had a maximum absorption band ($\lambda_{max}$) at a wavelength of 750 nm in toluene. The molar extinction coefficient ($\epsilon$) was determined to be ~30,500.

Example 5

Synthesis of
1,4,5,8-tetra(4-n-butylphenylamino)anthraquinone

A mixture of 10.87 g of 1,4,5,8-tetrachloroanthraquinone and 95 g of 4-n-butylaniline was allowed to react at 190° C. for 12 hours. The reaction mixture was then cooled to 70° C. and diluted with an equal amount of ethanol. On standing and further cooling to ambient temperature, some precipitate was formed. The mixture was filtered, washed and recrystallized from xylenes/isopropanol to give 6.6 g of a dark green crystalline material (>95% purity) with the structure confirmed by proton NMR as the desired product of 1,4,5,8-tetra(4-n-butylphenylamino)anthraquinone. This material had a maximum absorption band ($\lambda_{max}$) at a wavelength of 762 nm in toluene. The molar extinction coefficient ($\epsilon$) was determined to be ~36,900.

What is claimed is:

1. A method for marking a liquid petroleum hydrocarbon; said method comprising adding to the liquid petroleum hydrocarbon at least one substituted anthraquinone dye having formula (I)

(I)

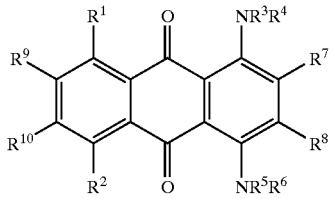

wherein $R^1$ and $R^2$ independently are hydrogen, hydroxy, $OR^{11}$, amino or $NR^{11}R^{12}$; $R^3$ and $R^5$ independently are alkyl, aryl, aralkyl, heteroalkyl or heterocyclic; $R^4$ and $R^6$ independently are hydrogen or alkyl; $R^7$, $R^8$, $R^9$ and $R^{10}$ independently are cyano, nitro or hydrogen, provided that at least two of $R^7$, $R^8$, $R^9$ and $R^{10}$ are cyano or nitro; $R^{11}$ is alkyl, aryl, aralkyl, heteroalkyl, heterocyclic or alkanoyl; $R^{12}$ is hydrogen or alkyl; and wherein said at least one substituted anthraquinone dye has an absorption maximum in the range from 690 nm to 1000 nm.

2. The method of claim 1 in which $R^7$, $R^8$, $R^9$ and $R^{10}$ independently are cyano or hydrogen, and $R^1$ and $R^2$ represent hydrogen, hydroxy or $NR^{11}R^{12}$.

3. The method of claim 2 in which $R^3$ and $R^5$ are $C_5$–$C_8$ cyclic alkyl, unsubstituted saturated acyclic alkyl, aryl substituted by at least one $C_2$–$C_{20}$ alkyl group, or aromatic heterocyclic substituted by at least one $C_2$–$C_{20}$ alkyl group; and said at least one substituted anthraquinone dye has an absorption maximum in a hydrocarbon solvent in the range from 710 nm to 970 nm.

4. The method of claim 1 further comprising at least one 1,4,5,8-tetrasubstituted anthraquinone dye having an absorption maximum in a hydrocarbon solvent from 690 nm to 800 nm and having formula (VI)

(VI)

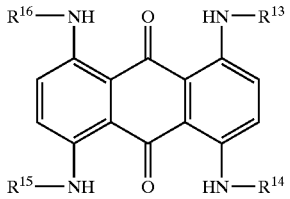

wherein $R^{13}$, $R^{14}$, $R^{15}$ and $R^{16}$ independently are alkyl, aryl, aralkyl, heteroalkyl or heterocyclic; provided that the dye of formula (I) and the dye of formula (VI) have absorption maxima separated by at least 30 nm.

5. The method of claim 4 in which $R^{13}$, $R^{14}$, $R^{15}$ and $R^{16}$ are aryl substituted by at least one $C_2$–$C_{20}$ alkyl group, aromatic heterocyclic substituted by at least one $C_2$–$C_{20}$ alkyl group, $C_5$–$C_8$ cyclic alkyl or unsubstituted saturated acyclic alkyl; and $R^7$, $R^8$, $R^9$ and $R^{10}$ independently are cyano or hydrogen.

6. The method of claim 1 further comprising at least one 1,4,5-trisubstituted anthraquinone dye having an absorption maximum in a hydrocarbon solvent from 630 nm to 700 nm and having formula (IX)

(IX)

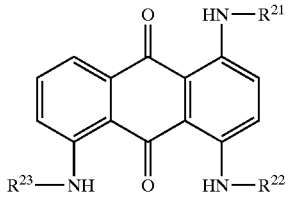

wherein $R^{21}$, $R^{22}$ and $R^{23}$ independently are alkyl, aryl, aralkyl, heteroalkyl or heterocyclic; provided that the dye of formula (I) and the dye of formula (VIII) have absorption maxima separated by at least 30 nm.

7. The method of claim 6 in which $R^{21}$, $R^{22}$ and $R^{23}$ are aryl substituted by at least one $C_2$–$C_{20}$ alkyl group or aromatic heterocyclic substituted by at least one $C_2$–$C_{20}$ alkyl group; and $R^7$, $R^8$, $R^9$ and $R^{10}$ independently are cyano or hydrogen.

8. The method of claim 1 further comprising at least one visible dye having an absorption maximum from 550 nm to 650 nm.

9. The method of claim 4 further comprising at least one 1,4,5-trisubstituted anthraquinone dye having an absorption maximum in a hydrocarbon solvent from 630 nm to 700 nm and having formula (IX)

(IX)

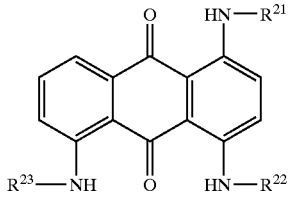

wherein $R^{21}$, $R^{22}$ and $R^{23}$ independently are alkyl, aryl, aralkyl, heteroalkyl or heterocyclic; provided that absorption maxima of any pair of the dyes of formula (I), formula (VI) and formula (IX) are separated by at least 30 nm.

10. The method of claim 9 in which $R^{13}$, $R^{14}$, $R^{15}$ and $R^{16}$ are aryl substituted by at least one $C_2$–$C_{20}$ alkyl group, aromatic heterocyclic substituted by at least one $C_2$–$C_{20}$ alkyl group, $C_5$–$C_8$ cyclic alkyl or unsubstituted saturated acyclic alkyl; and $R^7$, $R^8$, $R^9$ and $R^{10}$ independently are cyano or hydrogen.

* * * * *